United States Patent [19]

Sjoberg

[11] Patent Number: 4,770,206

[45] Date of Patent: Sep. 13, 1988

[54] MUD PUMP VALVE

[75] Inventor: James G. Sjoberg, Humble, Tex.

[73] Assignee: Chromium Corporation, Richardson, Tex.

[21] Appl. No.: 69,245

[22] Filed: Jul. 2, 1987

[51] Int. Cl.[4] ..... F16K 15/06

[52] U.S. Cl. ..... 137/516.29; 137/902; 251/332

[58] Field of Search ..... 251/332; 137/902, 533.29, 137/516.29

[56] References Cited

U.S. PATENT DOCUMENTS

| | | | |
|---|---|---|---|
| 452,357 | 5/1841 | Bavier . | |
| 1,709,807 | 4/1929 | Purnis . | |
| 1,948,628 | 2/1934 | Penick et al. | 251/332 |
| 1,968,200 | 7/1934 | Greve | 137/902 X |
| 2,969,951 | 1/1961 | Walton | 251/332 |
| 3,489,170 | 1/1970 | Leman | 137/516.29 |
| 4,518,329 | 5/1985 | Weaver | 251/332 X |

OTHER PUBLICATIONS

"Know Your Mud Pump", by TRW Mission, copyright 1965, pp. 38 and 48.

*Primary Examiner*—Arnold Rosenthal

*Attorney, Agent, or Firm*—Hubbard, Thurman, Turner & Tucker

[57] ABSTRACT

Disclosed is a mud pump valve which includes a seat ring adapted for insertion in a mud pump. The seat ring includes a frusto-conical seating surface and an annular seal ring groove about its outer periphery. A seal ring is positioned in and bonded to the seal ring groove. The seal ring has a frusto-conical sealing surface having an angle of taper greater than that of the seating surface of the seat ring. A closure disc is reciprocatingly mounted with respect to the seat ring and the closure disc includes a frusto-conical sealing surface having an angle of taper substantially the same as the angle of taper of the seating surface of the seat ring.

4 Claims, 1 Drawing Sheet

MUD PUMP VALVE

BACKGROUND OF THE INVENTION

A. Field of the Invention

The present invention relates generally to valves and more particularly to a valve for use in a mud pump.

B. Description of the Prior Art

During the drilling of oil and gas wells, drilling fluids are circulated within the bore hole by means of positive displacement pumps commonly called mud pumps. The inlet and the outlet ports of mud pumps are provided with poppet-type valves, which include a seat ring and a valve disc adapted for reciprocal motion with respect to the seat ring. Typically, the valve disc also includes an elastomer insert or seal ring fitted into a groove around the periphery of the valve disc. In order to accommodate and carry the seal ring, the valve disc is typically a relatively large and massive structure.

The seal ring engages a relatively steeply tapered frusto-conical surface on the seat ring when the valve is in the closed position. The steep taper of the sealing surface of the seat ring requires that the valve disc be lifted a relatively large distance in order to open the valve to allow mud flow. The combination of the high lift and large mass of the valve disc results in substantial inertia as the valve disc travels back and forthb etween the open and closed positions. The high inertia makes the valve operate relatively sluggishly and results in slamming of the valve to the closed position, which increases wear on the valve parts.

SUMMARY OF THE INVENTION

It is therefore an objective of the present invention to provide a mud pump valve that overcomes the shortcomings of the prior art. More specifically, it is an objective of the present invention to provide a mud pump valve in which the reciprocating mass is reduced. It is a further objective of the present invention to provide a mud pump valve in which the impact of the valve closure member during closing is reduced. It is yet a further objective of the present invention to provide a mud pump valve having increased useful life.

Briefly stated, the forgoing and other objects are accomplished by the valve of the present invention, which includes a seat ring adapted for insertion in the mud pump and a valve disc mounted for reciprocal movement with respect to the seat ring between an open position and a closed position. The seat ring includes a frusto-conical seating surface having a relatively flat angle of taper. The seat ring includes an annular seal ring groove formed about its outer periphery.

A seal ring is positioned in and bonded to the seal ring groove. The seal ring has a frusto-conical sealing surface contiguous with the seating surface of the seat ring. The angle of taper of the sealing surface is slightly greater than that of the seating surface of the seat ring.

The valve includes a closure disc reciprocatingly mounted with respect to the seat ring. The closure disc has a frusto-conical seating and sealing surface with an angle of taper substantially equal to the angle of taper of the seating surface of the seat ring. The closure disc is thus matable with the seat ring. The sealing surface of the closure disc sealingly engages the seal ring when the closure disc is in the closed position.

By locating the seal ring in the seat ring, the size and mass of the closure disc is reduced substantially. By reducing the angle of taper of the mating surfaces of the seat ring and closure disc, the lift of the closure disc during operation of the valve is substantially reduced. The combination of the low mass closure disc and low lift results in a valve that is more responsive and less subject to wear. The configuration of the seal ring and the bonding of the seal ring to the seat ring reduces or prevents movement between the seal and the seat ring, which prevents the accumulation of fluid between the seal and the seat ring and reduces wear of the seal ring.

DESCRIPTION OF THE PREFERRED EMBODIMENT

Figure 2:
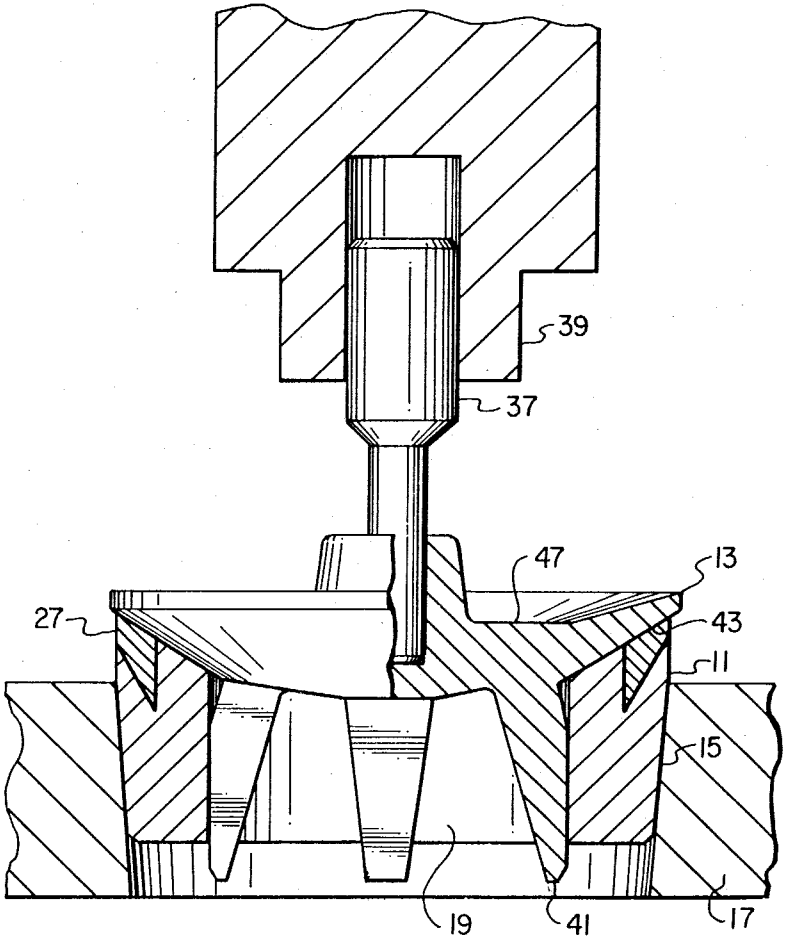
FIG. 2 is a partional sectional view of the valve of the present invention in the closed position.
Figure 1:
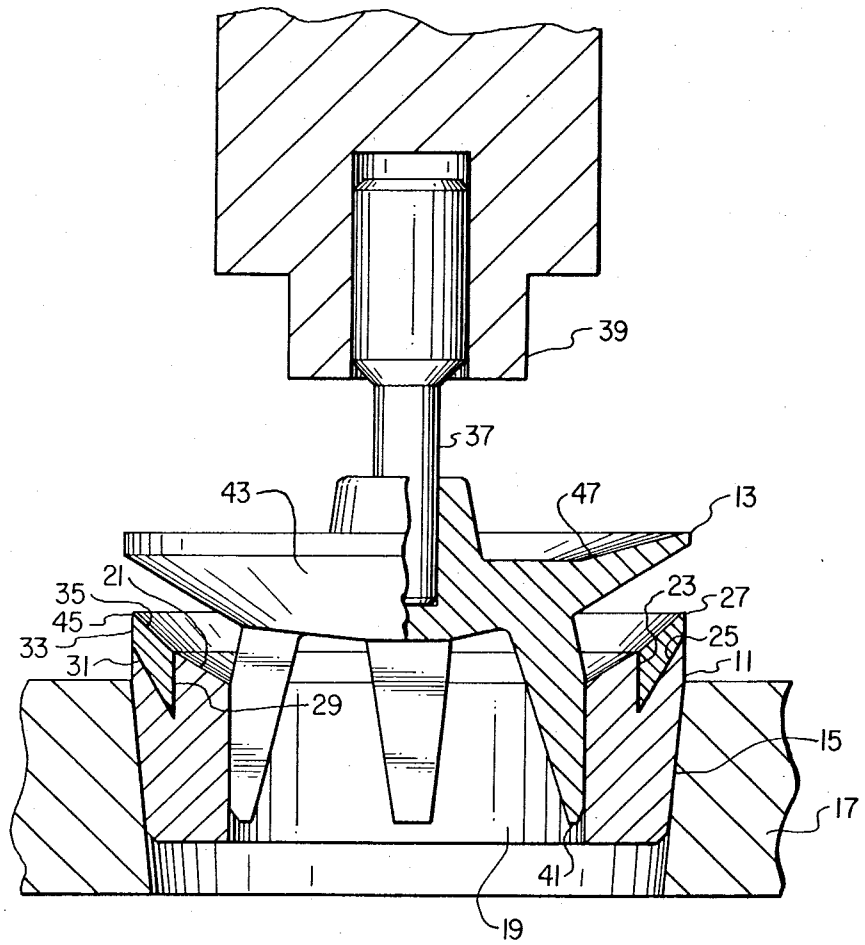
FIG. 1 is a partial sectional view of the valve of the present invention in the open position.

Referring now to the drawings, the valve of the present invention includes a seat ring 11 and a closure disc 13. Seat ring 11 has a frusto-conically tapered outer surface 15 adapted for insertion into the valve deck of a mud pump. Seat ring 11 has a central cylindrical bore 19 which forms a flow way through seat ring 11.

Seat ring 11 includes an upwardly facing frusto-conical seating surface 21. Seating surface 21 has an angle of taper (measured with respect to the horizontal in the figures) that is relatively shallow. The angle of taper of seat surface 21 is preferrably less than about 45° and most preferrably equal to about 30°.

Seat ring 11 has about its outer periphery continguous with seating surface 21 a seal ring groove defined by a first side 23 and a second side 25. First side 23 is cylindrical and is substantially parallel to the axis of seat ring 11. Second side 25 is of upwardly facing frusto-conical configuration and preferably has an angle of taper (again measured with respect to horizontal in the figures) that is greater than the angle of taper of seating surface 21.

The seal ring groove defined by sides 23 and 25 contains a seal ring 27. Seal ring 27 is of a tough plastic material such as polyurethane and includes a cylindrical first side 29 and a frusto-conical second side 31. First side 29 of seal ring 27 is bonded to first side 23 of seat ring 11 and second side 31 of seal ring 27 is bonded to second side 25 of seat ring 11 by a suitable adhesive. Seal ring 27 also includes a substantially cylindrical third side 33 that is substantially parallel to the axis of seat ring 11. The fourth side of seal ring 27 defines an upwardly facing frusto-conical sealing surface 35. The angle of taper of sealing surface 35 is greater than the angle of taper of seating surface 21 of seal ring 11. In the preferred embodiment, the angle of taper of sealing surface 35 is equal to about 32°. Preferably, however, the angle of taper of sealing surface 35 is less than the angle of taper of second side 25 of the seal ring groove. Seal ring 27 thus has a dovetail cross section and seal ring 27 is effectively trapped in the seal ring groove. Preferably, seal ring 27 is formed in place in the seal ring groove.

Closure disc 13 is supported for reciprocating movement between open and closed positions by a valve stem 37 slidingly supported by an upper stem guide 39, which is a part of the mud pump, and at least three legs 41 slidingly disposed within bore 19 of seat ring 11. The lower surface of closure disc 13 includes a single downwardly facing frusto-conical seating and sealing surface 43 having a constant angle of taper substantially equal to the angle of taper of seating surface 21 of seat ring 11. Closure disc 13 is thus matable with seat ring 11. The upper surface 47 of closure disc 13 is preferably concave in order to reduce the mass of closure disc 13.

The outside diameter of closure disc 13 is larger than the outside diameter of seal ring 27. Thus, as closure disc 13 moves toward the closed position, initial contact between seating and sealing surface 43 of closure disc 13 and seal ring 27 occurs at the sharp intersection 45 of sealing surface 35 and third side 33 of seal ring 27. The initial contact forms a line closure to seal the valve. Some slight further movement of closure member 13 occurs after line contact until seating and sealing surface 43 seats on a seating surface 21 of seat ring 11. Such further movement compresses and deforms slightly seal ring 27, but because of its dovetail shape and bonded connection with the seal ring groove, the wear to seal ring 27 is minimized. Seal ring 27 is trapped in the seal ring groove and stress on the bonds between the seal ring groove and seal ring 27 during opening and closing of the valve minimal. The closing of closure disc 13 forces seal ring 27 into tighter engagement with the seal ring groove.

What is claimed is:

1. A mud pump valve, which comprises:

a seat ring adapted for insertion in a mud pump, said seat ring including an outwardly facing frusto-conical seating surface having an angle of taper, said seat ring including an annular seal ring groove formed therein, said seal ring groove being defined by cylindrical first side substantially parallel to the axis of said seat ring and an outwardly facing frusto-conical second side contiguous with said first side, said second side having an angle of taper greater than the angle of taper of said seating surface of said seat ring;

a seal ring positioned in said seal ring groove, said seal ring including a cylindrical first side bonded to said first side of said seal ring groove, said first side of said seal ring being substantially parallel to the axis of said seal ring and having a length substantially equal to the length of said first side of said seal ring groove and a second side bonded to said second side of said seal ring groove, said second side having a length substantially equal to the length of said second side of said seal ring groove and an angle of taper substantially equal to the angle of taper of said second side of said seal ring groove, and said seal ring including an outwardly facing frusto-conical sealing surface having an angle of taper greater than the angle of taper of said seating surface of said seat ring but less than the angle of taper of said second side of said seal ring groove, whereby said seal ring has a dovetail cross section;

a closure disc reciprocatingly mounted with respect to said seat ring and movable between an open position and a closed position, said closure disc including a single inwardly facing frusto-conical seating and sealing surface having a constant angle of taper substantially equal to the angle of the taper of said seating surface of said seat ring, said sealing and seating surface sealingly engaging said seal ring and seating on said seating surface of said seat ring in said closed position.

2. The mud pump valve as claimed in claim 1, wherein said seal ring includes a substantially cylindrical third side contiguous with said sealing surface and said second side of said seal ring, said third side of said seal ring being unsupported by said seat ring.

3. The mud pump valve as claimed in claim 1, wherein the angle of taper of said sealing surface of said seal ring is less than about 45°.

4. The mud pump valve as claimed in claim 1, wherein the outside diameter of said closure disc is greater than the outside diameter of said seal ring.

* * * * *